US012703463B2

(12) United States Patent
Fishburn

(10) Patent No.: US 12,703,463 B2
(45) Date of Patent: Aug. 11, 2026

(54) PONTOON BOAT WITH TUNING PLATES

(71) Applicant: Polaris Industries Inc., Medina, MN (US)

(72) Inventor: Bradley R. Fishburn, Syracuse, IN (US)

(73) Assignee: POLARIS INDUSTRIES INC., Medina, MN (US)

( * ) Notice: Subject to any disclaimer, the term of this patent is extended or adjusted under 35 U.S.C. 154(b) by 398 days.

(21) Appl. No.: 18/465,640

(22) Filed: Sep. 12, 2023

(65) Prior Publication Data

US 2024/0092462 A1 Mar. 21, 2024

Related U.S. Application Data

(60) Provisional application No. 63/407,411, filed on Sep. 16, 2022.

(51) Int. Cl.

| | |
|---|---|
| ***B63B 39/06*** | (2006.01) |
| ***B63B 1/12*** | (2006.01) |
| ***B63B 35/34*** | (2006.01) |

(52) U.S. Cl.

CPC ..... *B63B 39/06* (2013.01); *B63B 1/121* (2013.01); *B63B 35/34* (2013.01); *B63B 2039/067* (2013.01)

(58) Field of Classification Search

CPC ..... B63B 39/06; B63B 1/121; B63B 35/34; B63B 2039/067

See application file for complete search history.

(56) References Cited

U.S. PATENT DOCUMENTS

| | | | | |
|---|---|---|---|---|
| 2,677,139 | A * | 5/1954 | Canazzi | B63B 39/06 114/142 |
| 5,184,561 | A * | 2/1993 | Nickell, Jr. | B63B 1/12 114/292 |
| 5,570,650 | A * | 11/1996 | Harley | B63B 1/20 114/67 R |
| 5,784,977 | A * | 7/1998 | Schell | B63B 1/121 114/61.24 |
| 7,950,340 | B1 | 5/2011 | Curtis | |
| D865,634 | S | 11/2019 | Spade et al. | |
| 10,518,843 | B1 * | 12/2019 | Melvin | B63B 1/24 |
| 10,556,642 | B1 | 2/2020 | Massicotte et al. | |
| 10,589,823 | B1 * | 3/2020 | Fenech | B63B 1/125 |
| 10,850,807 | B2 * | 12/2020 | Neibert | B63B 35/613 |

(Continued)

FOREIGN PATENT DOCUMENTS

| | | |
|---|---|---|
| JP | S55127273 | 10/1980 |
| JP | 2006036008 | 2/2006 |

*Primary Examiner* — Benjamin P Lee

(74) *Attorney, Agent, or Firm* — SCHWEGMAN LUNDBERG & WOESSNER, P.A.

(57) ABSTRACT

A pontoon boat with a motor arrangement has multiple chines on the pontoons and has a plurality of chine wedges positioned in respective reverse chines. The chine wedges providing a optimal balancing of the performance characteristics of the pontoon boat. The pontoon boat may be performance tuned by positioning the chine wedges at alternate positions or utilizing alternately shapes, sizes, or orientations of chine wedges. The chine wedge may be readily attached and detached utilizing threaded fasteners which extend into foils mounted on the pontoon, the foils partially defining the reverse chines into which the chine wedges are placed.

7 Claims, 6 Drawing Sheets

(56) References Cited

U.S. PATENT DOCUMENTS

| | | | | |
|---|---|---|---|---|
| 10,953,955 | B1 * | 3/2021 | Fieldhouse | B63B 1/32 |
| 11,192,610 | B2 * | 12/2021 | Fishburn | B63B 35/38 |
| 11,312,450 | B1 * | 4/2022 | Rose | B63H 21/30 |
| 11,427,284 | B1 | 8/2022 | Lieb | |
| 11,661,148 | B2 * | 5/2023 | Fishburn | B63B 1/125 114/61.22 |
| 11,993,347 | B2 * | 5/2024 | Fishburn | B63B 35/38 |
| 12,459,601 | B2 * | 11/2025 | Fishburn | B63B 35/38 |
| 2014/0366791 | A1 * | 12/2014 | Poppell | B63B 7/04 114/61.18 |
| 2021/0129944 | A1 * | 5/2021 | Fishburn | B63B 35/34 |
| 2021/0229777 | A1 * | 7/2021 | Fishburn | B63B 1/125 |
| 2023/0271676 | A1 * | 8/2023 | Fishburn | B63B 35/34 114/61.22 |
| 2024/0270349 | A1 * | 8/2024 | Fishburn | B63B 35/38 |
| 2024/0417043 | A1 * | 12/2024 | Thomalla | B63B 35/34 |
| 2025/0115332 | A1 * | 4/2025 | Dougherty | B63B 1/18 |
| 2025/0115334 | A1 * | 4/2025 | Dougherty | B63B 1/18 |

* cited by examiner

PONTOON BOAT WITH TUNING PLATES

CROSS-REFERENCE TO RELATED APPLICATIONS

This application claims the benefit of U.S. Provisional Application No. 63/407,411, filed Sep. 16, 2022, the entire contents of which are incorporated by reference herein.

BACKGROUND OF THE INVENTION

Pontoon boats have gained tremendous popularity based on their smooth rides and capabilities of handle a high number of passengers comfortably. A great advantage of pontoon boats compared to conventional single hulled boats, is that they provide a wide range of passenger seating arrangements for the manufacturers. Advanced pontoon boats are also capable of handling one or more high horsepower engines with top speeds approaching or equivalent to solid hull boats. A challenge for pontoon boat manufacturers is providing differently sized and configured pontoon boats, with different motor options, while still maintaining optimal combinations of speed, comfortable smooth rides for the passengers, and handling capabilities. Moreover, these performance characteristics need to be maintained under highly variable passenger loading conditions and water/weather conditions. Adjusting the physical size and placement and orientation of structures and equipment on pontoon boats to provide an optimal balance of performance features is appropriately termed "tuning" of the pontoon boat. Any improvements in the means for accomplishing and balancing these performance goals, that is tuning of the pontoon boats, would be welcomed by the pontoon boat manufacturers and by the pontoon boating enthusiast.

SUMMARY OF THE INVENTION

The inventor has recognized that providing optimal combinations of speed, handling capabilities, and smooth rides on pontoon boats under varying passenger loading conditions can be accomplished utilizing particular features on the pontoons of pontoon boats. Particular chine arrangements on the pontoons of pontoon boats have been discovered by the inventor of this application to provide an effective means of balancing performance characteristics. See U.S. Pat. No. 11,192,610 owned by the owner of this application and with the inventor of this application as an inventor. Said application is incorporated by reference herein for all purposes. See Prior Art FIG. 1 for a particular chine arrangement. Chines defined by V-shaped foils with the apex of the V pointing outwardly and downwardly from the pontoon extend the length of or a substantial length of the pontoon to which they are attached. The foils are typically aluminum extrusions welded to the pontoons. The foils, when viewed from an end of the respective pontoons, provide a positive chine defined by the V-shaped foil and provide a reverse or negative chine defined between the V-shape foil and the pontoon surface below the V-shaped foil.

The inventor has discovered that providing a chine wedge in the reverse chine with a forward upward angulation can provide a dramatic tuning option for optimal balancing of the performance parameters. In embodiments, the chine wedges are attached to an inside foil of each of the outside pontoons of the pontoon boat, the chine wedge being permanently attached to the V-shaped foil and to the pontoon by way of welding. The pontoon manufacturer may determine the optimal location of the chine wedge by testing. For example, testing has shown in certain configured pontoon boat/motor combinations placement of the chine wedges forward of the center of gravity of the pontoon (determined in an unloaded without passenger condition), and intermediate the forward end and rearward ends of the reverse chine, provides a significant reduction of the bow of the pontoon boat diving during engine trimming and further may inhibit porpoising of the pontoon boat.

In embodiments, the chine wedge has a flat plate that is triangular or pie shaped with a forward pointed end nested in the apex of the reverse chine and a rearward edge extending from proximate the exterior apex of the V-shaped foil to the outer surface of the pontoon. In embodiments, the angulation of the chine wedge from horizontal, as defined by axis of the two outer pontoons, is in the range of 10° to 45°. In embodiments, the overall length of the chine wedge is from 6 inches to 28 inches. In embodiments, the angulation of the chine wedge from horizontal, as defined by axis of the two outer pontoons, is in the range of 15° to 40°. In embodiments, the overall length of the chine wedge is from 10 inches to 22 inches.

In embodiments, tuning of a particular pontoon boat configuration with a particular motor arrangement is accomplished with a plurality of tuning wedges temporarily attached to the pontoons at a first position in reverse chines that can provide data on performance characteristics which can then be compared to performance characteristics with the tunning wedges temporarily attached to the reverse chines on the pontoons at a second position. This may be repeated for additional positions with observation and recording of performance parameters at the different positions and the determination of an optimal position for a desired balancing of performance parameters may be made. This is suitable, for example, for a particular pontoon boat design with a particular outboard motor arrangement that will be sold as a package by a manufacturer. When the desired chine wedge position is selected, the chine wedges may be permanently attached during the manufacture of such pontoon boats of said configuration by welding the chine wedges to the pontoons.

In embodiments, a plurality of tuning wedges temporarily attached to the pontoons at a first angulation or a first length, and/or a first shape, may provide data on performance characteristics which can then be compared to performance characteristics with the tunning wedges temporarily attached to the pontoons at a second angulation, or a second length, and/or a second shape. This may be repeated for additional angulations, lengths, and/or shapes with observation and recording of performance parameters and the determination of desired or optimal angulations, lengths, and/or shapes for a desired balancing of performance parameters may be made. Additionally, the performance characteristics may be recorded at different loading quantities, that is for example, different passenger levels utilizing the alternate positions.

A feature and advantage of embodiments is that a variety of shapes and lengths of chine wedges may be provided for tuning of a particular pontoon and outboard motor configuration along with variable or alternate positioning, including angulation, of the chine wedges at the reverse chines providing an array of tuning options for a selected mix of performance characteristics.

In an embodiment, chine wedges may be configured for temporary attachment to the pontoons during the tuning process. For example, each chine wedge may have an elongate tab on a side of the wedge to be attached to the V-shaped foil. Apertures can allow fasteners to extend through the tab into the V-shaped foil for temporary attachment of the chine wedges to the pontoons for collection of data purposes. Of course, utilization of the tabs for permanent attachment of the chine wedges, rather than welding the chine wedges to the pontoons and V-shaped foils may be appropriate. This is particularly the case where performance tuning is being performed, not during the design process of a particular pontoon boat and motor arrangement, but after the pontoon boat has been manufactured and where it has in place a particular outboard motor arrangement. Attachment to the outer surface of the pontoons with fasteners is problematic in that it destroys the integrity of the pontoon; however, the attachment of the chine wedges by way of an integral tab on the chine wedge to the V-shaped foil does not impact the integrity of the pontoon and is believed to be an adequate temporary or permanent attachment. In embodiments, a plurality of chine wedges provide an aftermarket tuning option for owners or dealers of existing pontoon boats A feature and advantage of embodiments is that an effective tuning method for balancing the performance parameters is provided to manufacturers for new pontoon boat configurations and to owners of existing pontoon boats.

A means for tuning a pontoon boat having a plurality of a plurality of pontoons running longitudinally beneath the deck and providing buoyancy to the pontoon boat. The plurality of pontoons include a multi-chine configuration that increases the stability of the pontoon boat and provides handling characteristics similar to that of a single hulled boat. The plurality of pontoons include two outer pontoons and may include a third pontoon positioned laterally intermediate the outer pontoons. The third pontoon may include a plurality of longitudinal foils defining chines, and each of the outer pontoons may include at least one outer foil. At least a portion of each of the at least one chines of the outer pontoons may be positioned vertically below the plurality of chines of the third pontoon. The chines on the third pontoon may extend longitudinally further than each of the at least one chines of the outer pontoons.

A feature and advantage of embodiments is that a chine wedge is provided that has a plate portion that bridges a foil on a pontoon and the pontoon surface, that has an upward inclination facing forward. In embodiments, the rearward edge of the chine wedge defines the rearward end of the chine wedge. In embodiments, the chine wedge has a rigid flap portion that substantially closes the rearward opening defined by the rearward edge of the plate portion, the foil, and the pontoon. In embodiments, the flap is welded to the pontoon surface and/or the surface of the foil.

In embodiments, a kit comprises a plurality of chine wedges as described herein, fasteners, instructions for performance tuning a pontoon boat utilizing the wedges and methods described herein, and packaging for the kit components.

DETAILED DESCRIPTION

Figure 1:
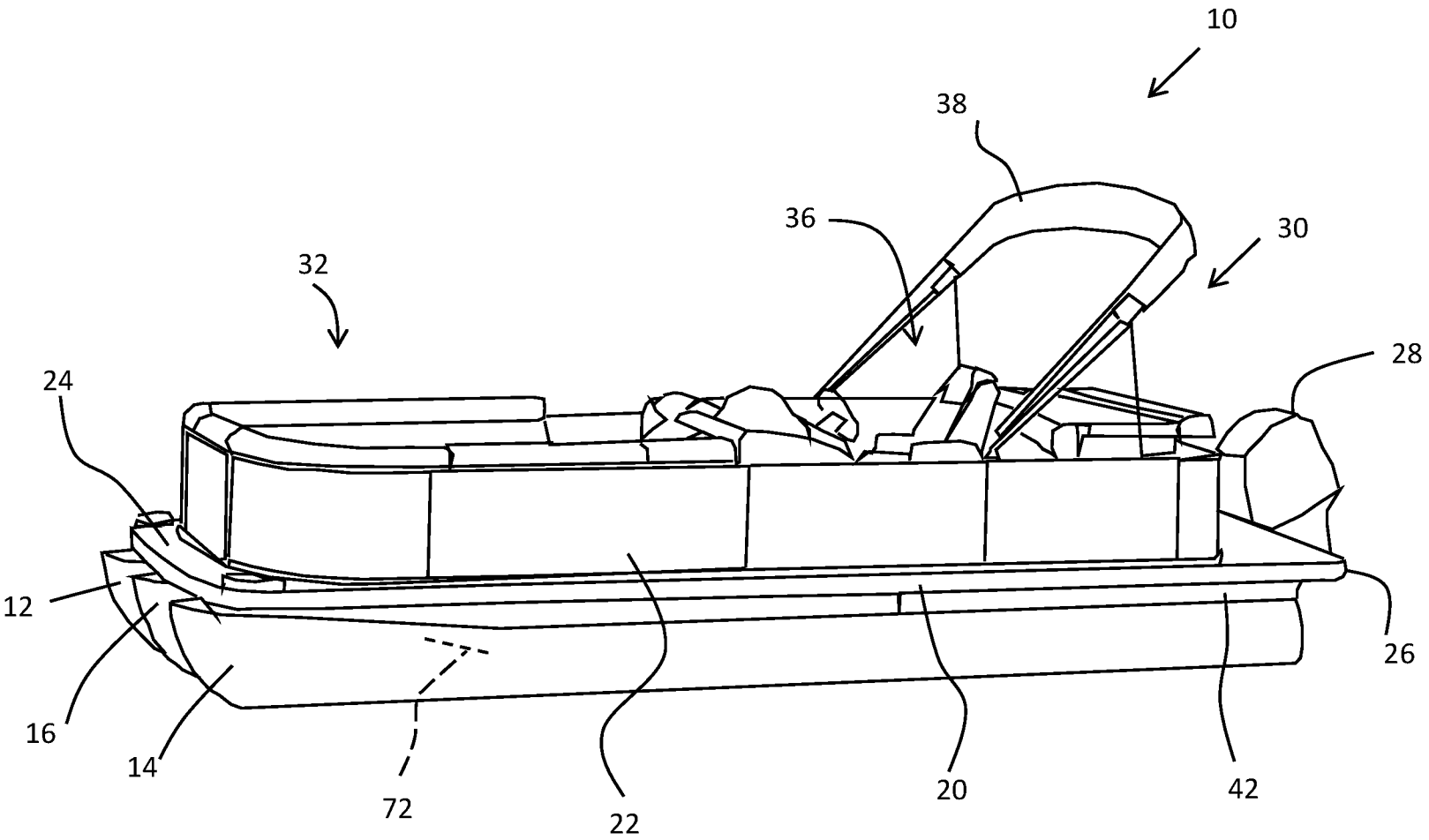
FIG. 1 is a perspective view of a pontoon boat in accord with embodiments
Figure 2:
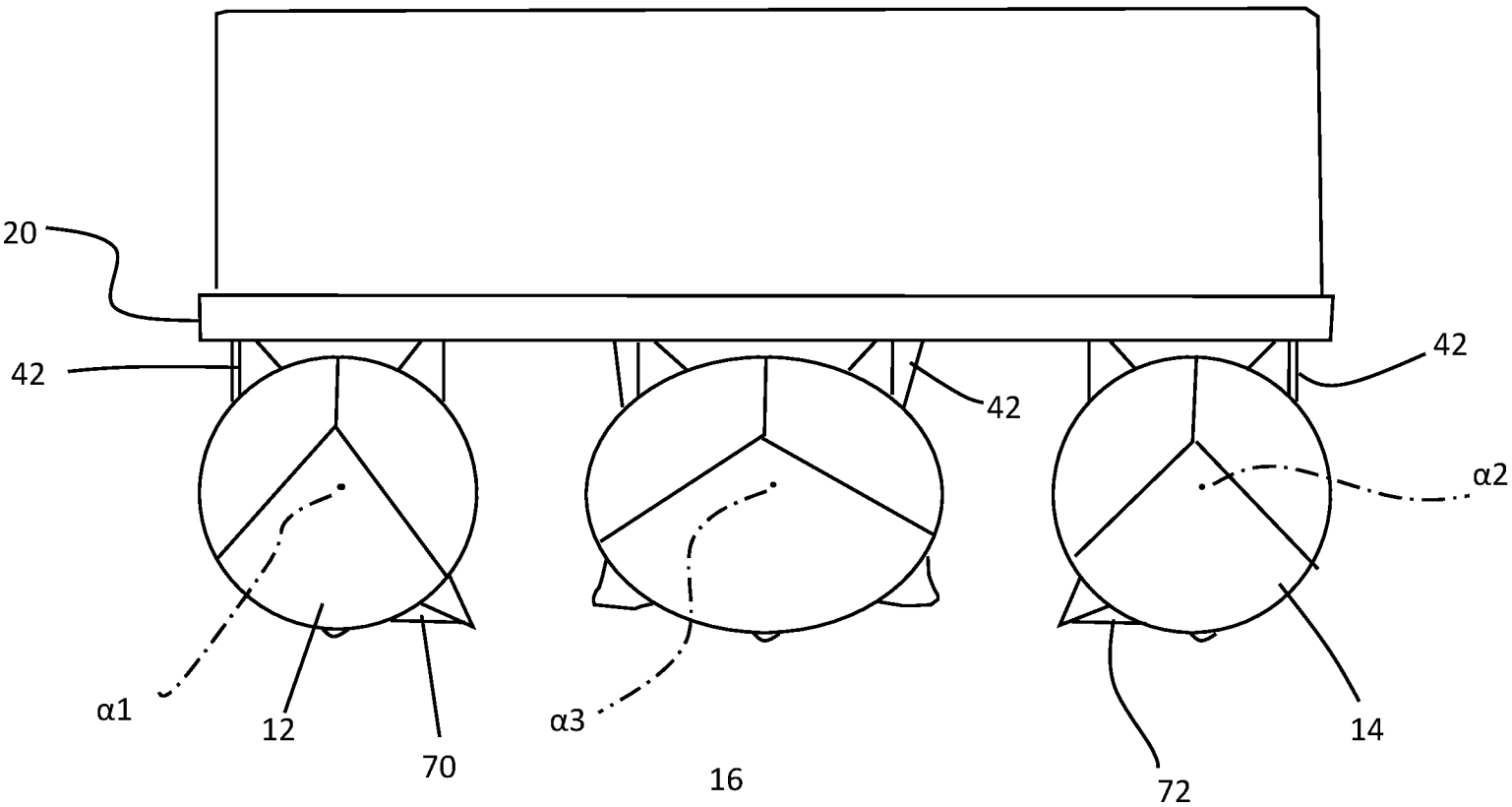
FIG. 2 is front elevational view of a pontoon boat with a pair of chine wedges on the starboard and port pontoons.

Referring to FIGS. 1 and 2, in embodiments, a pontoon boat 10 includes a plurality of pontoons, including starboard pontoon 12, a port pontoon 14, and a third central pontoon 16. A deck 20 is mounted on and above pontoons 12, 14, 16 and extending in a generally horizontal plane. Deck 20 is supported by the plurality of pontoons. The deck has a railing 22 extending generally around the periphery of the deck 20 from the bow end 24 to the stern end 26. The pontoons have axis $\alpha 1$, $\alpha 2$, and $\alpha 3$, which are parallel. The outboard and port axis $\alpha 1$, $\alpha 2$ are coplanar.

A motor arrangement 28, illustrated as an outboard engine, at the stern end operably coupled to pontoon 16 proximate stern end 26 of deck 20. In other embodiments, motor arrangement 28 may comprise an inboard/outboard engine or a multi-outboard engine configuration. Deck 20 may include thereon a rearward seating area 30 and a forward seating area 32. Rearward seating area 30 also includes an operator region 36. Pontoon boat 10 may also include a collapsible canopy 38 coupled to railing 22.

Referring to FIGS. 2-4A, the deck generally has a framework 40 with cross members to which pontoon supporting structure 42 is attached. See U.S. Pat. No. 11,192,610, owned by the owner of this application and incorporated by reference herein for all purposes. The pontoons 12, 14, 16 having strakes or foils 46, 48, 49, 50 which may be formed by extruding aluminum and welding the extrusions to the pontoon. Some of the extrusions may extend essentially the entire length of the pontoons and some may extend only a portion of the length of the pontoons. For example, the strakes or foils 46, 50 on the inside and downward facing quartiles of the starboard and port pontoons 12, 16 are illustrated as extending only a portion of the lengths of the pontoons. These foils define a positive chine 52, 53 with the projections 54, 55 of the foils extending outwardly and downwardly. These foils 46, 50 also define negative or reverse chines 60, 61 defined by the exterior surfaces 62 of the foils 46, 50 and the exterior surfaces 64, 65 of the pontoons 12, 14. The foils are typically welded to the pontoon with weldments 67, 68.

Figure 3:
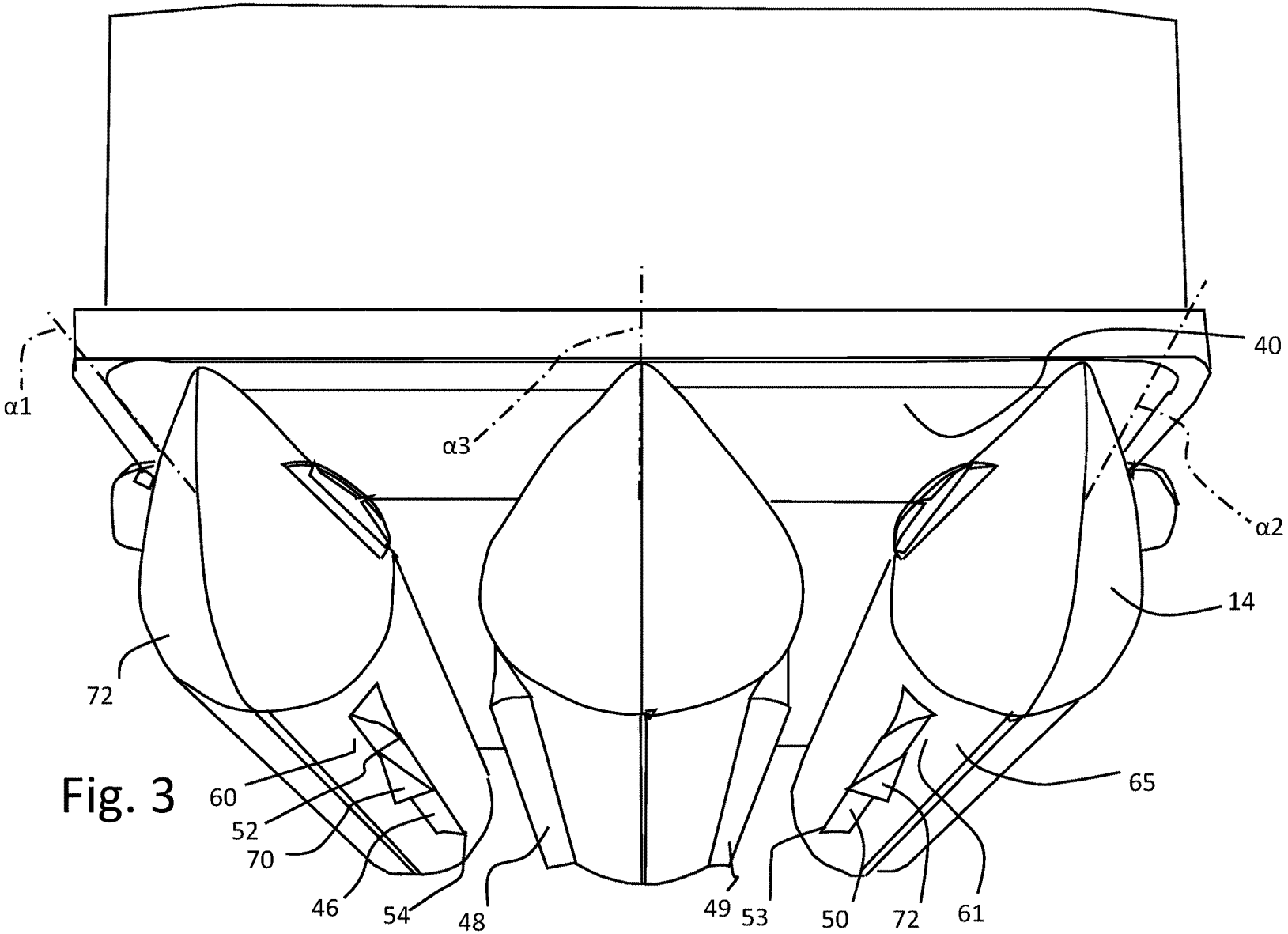
FIG. 3 is a upward looking front perspective view of the pontoon boat of FIG. 2.
Figure 4A:
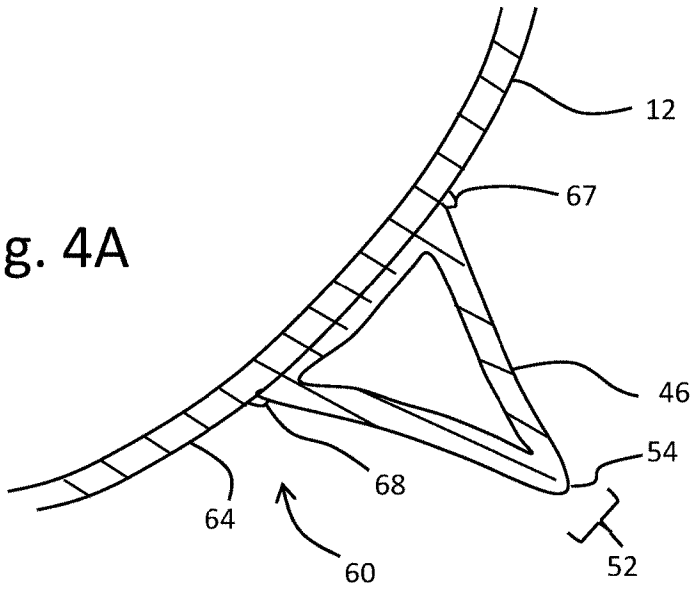
FIG. 4A is a cross sectional view showing a portion of the starboard pontoon with the foil welded thereto.
Figure 4B:
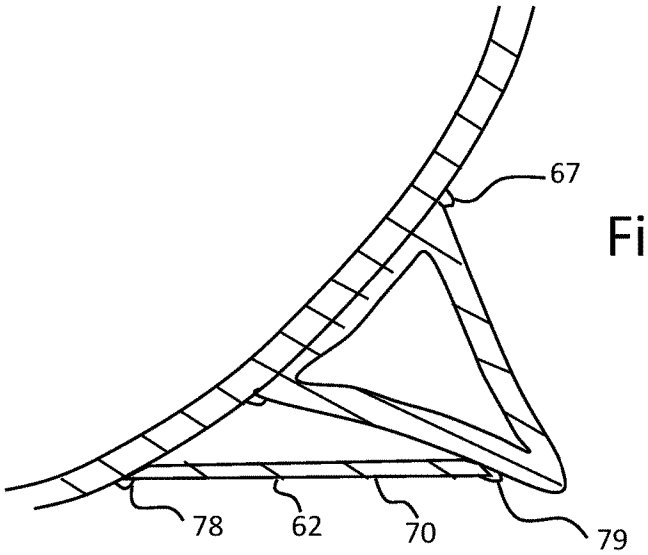
FIG. 4B is a cross sectional view similar to FIG. 4A with a chine wedge permanently attached to the pontoon and foil by weldments.
Figure 4C:
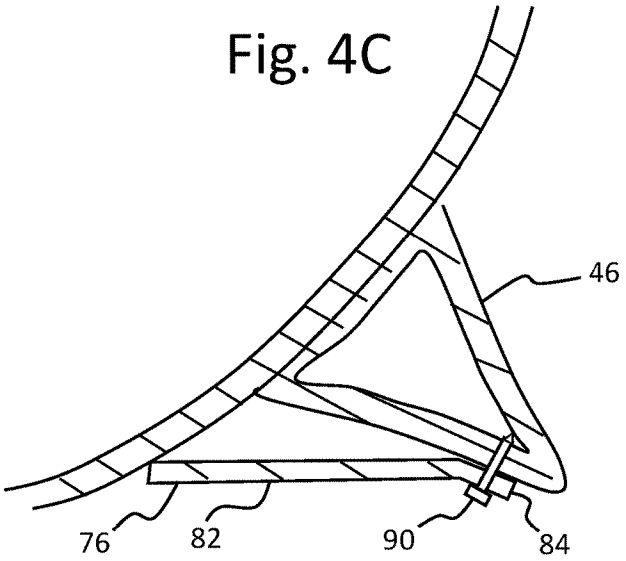
FIG. 4C is a cross sectional view similar to FIG. 4A with a chine wedge temporarily attached to the foil by a threaded fastener extending into the foil.
Figure 11:
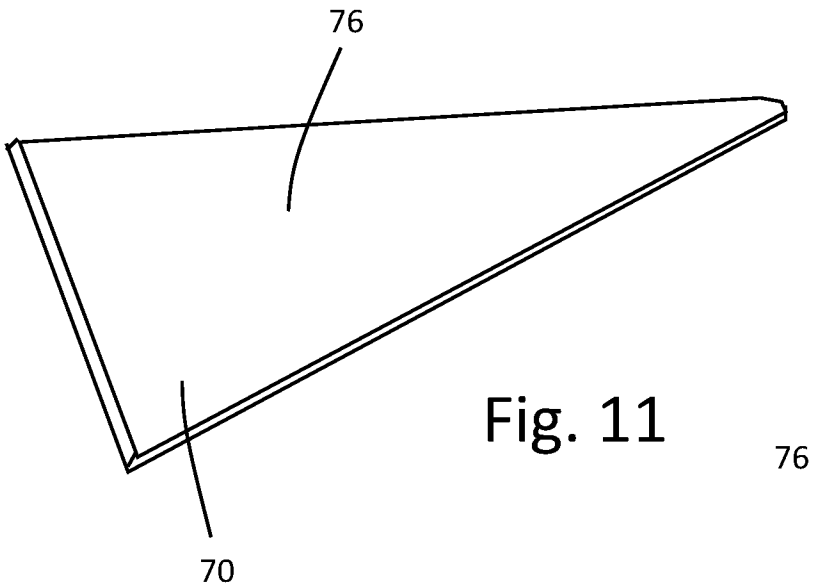
FIG. 11 is a perspective view of unattached chine wedge.
Figure 12:
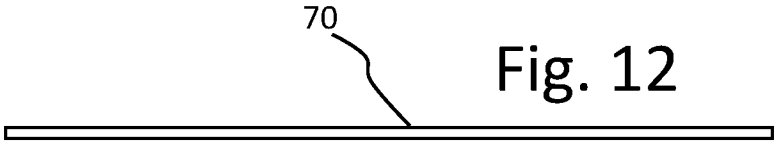
FIG. 12 is a side elevational view of the chine wedge of FIG. 11.

Referring to FIGS. 2 and 3, lift plates configured as chine wedges 70, 72 are illustrated attached to the starboard and port pontoons 12, 14 at the reverse chines 60, 61. The chine wedges are positioned are desired locations that are determined to provide favorable performance parameters of selected performance parameters. An exemplary chine is illustrated in FIGS. 11 and 12 and may be formed of aluminum plate and comprise a plate portion 76 that is flat and may be planar. The chine wedges may be permanently attached to the respective pontoons by weldments 78, 79. See in particular FIG. 4B.

As best illustrated in FIGS. 4B and 5-10, the chine wedges are positioned in the reverse chines 60, 61 and oriented such that the plate portion has a forward upward inclination. FIG. 1 illustrates a suitable upward the inclination of chine wedge 72 shown in dashed lines as it is hidden on the inside face of the port pontoon 14. The chine wedge thus provides a lift surface for the water that is flowing through and constrained in the reverse chines 60, 61. Suitable angulation of the chine wedge is believed to in the range of 15° to 40° from horizontal. The overall length of the chine wedges is appropriately in the range of 6 to 28 inches in embodiments. Other sizes and inclinations may be suitable in particular applications.

Referring to FIGS. 4C, 5-10, 13-15, rather than the chine wedge being permanently welded to the respective pontoons, the chine wedge 82 may be attached by means other than welding such that the attachment need not be permanent. The chine wedge 82 having the plate portion 76 but also having an attachment portion or tab 84 that may be unitary with the plate portion. The attachment tab may have predrilled holes 87 indicated by the dashed circles for use in attachment to the respective foils defining the reverse chine. Such chine wedge may be suitably secured only to the respective foil with threaded fasteners or other suitable fasteners such as rivets. In that almost all the loading on the chine wedge is towards the pontoon, fastening only one side of the chine wedge at the foil, and not to the pontoon directly is believed to be adequate in most all cases. The chine wedge removal is easy by removing the threaded fasteners. The user may leave the holes in the foil or may otherwise fill the unused holes.

Figure 5:
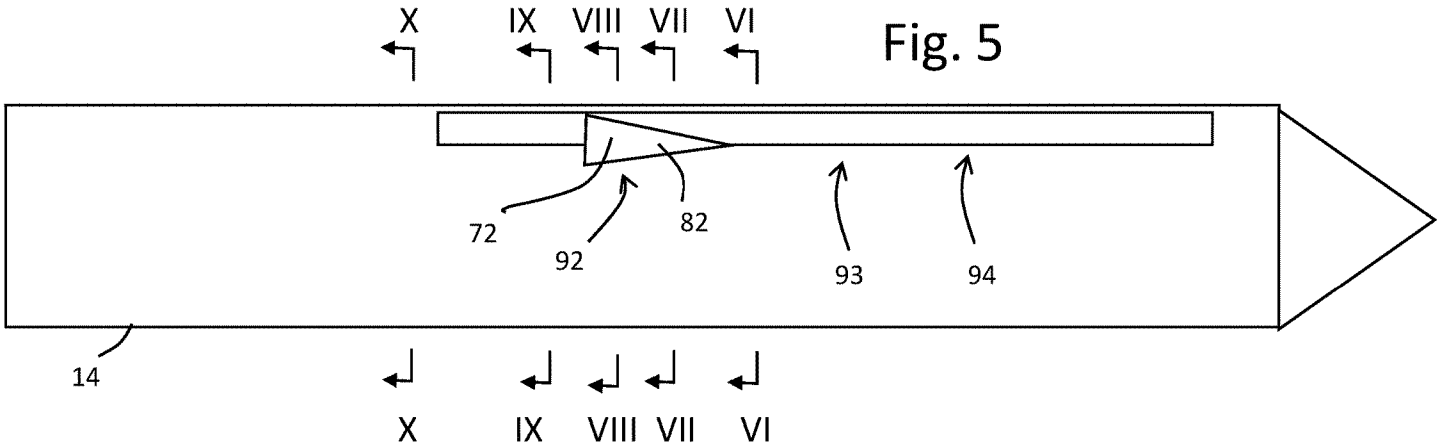
FIG. 5 is an upwardly looking plan view of a starboard pontoon showing a chine wedge secured to the pontoon at the chine defined by the starboard pontoon foil and exterior surface of the starboard pontoon.
Figure 6:
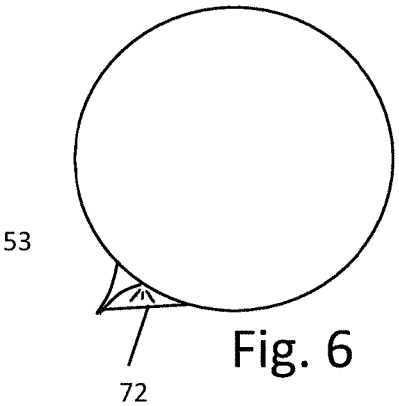
FIG. 6 is a cross sectional view of the pontoon taken at line VI-VI of FIG. 5.
Figure 7:
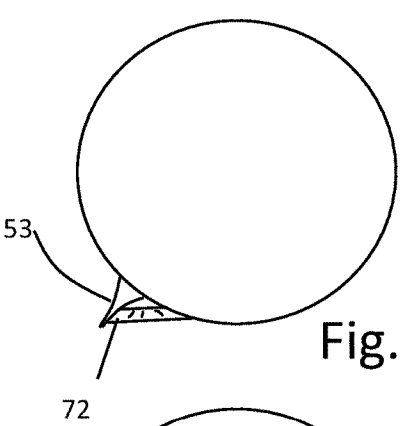
FIG. 7 is a cross sectional view of the pontoon taken at line VII-VII of FIG. 5.
Figure 8:
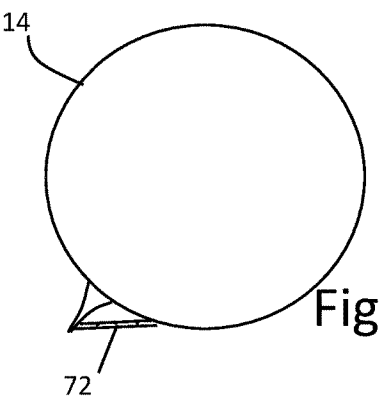
FIG. 8 is a cross sectional view of the pontoon taken at line VIII-VIII of FIG. 5.
Figure 9:
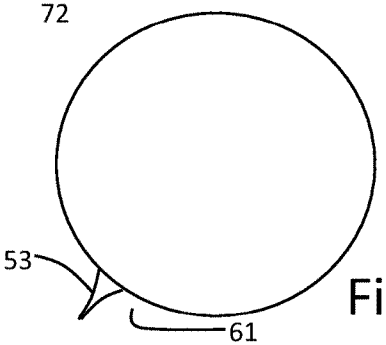
FIG. 9 is a cross sectional view of the pontoon taken at line XI-XI of FIG. 5.
Figure 10:
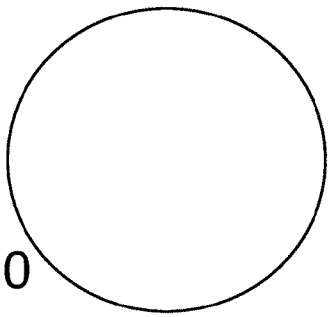
FIG. 10 is a cross sectional view of the pontoon taken at line X-X of FIG. 5.
Figure 13:
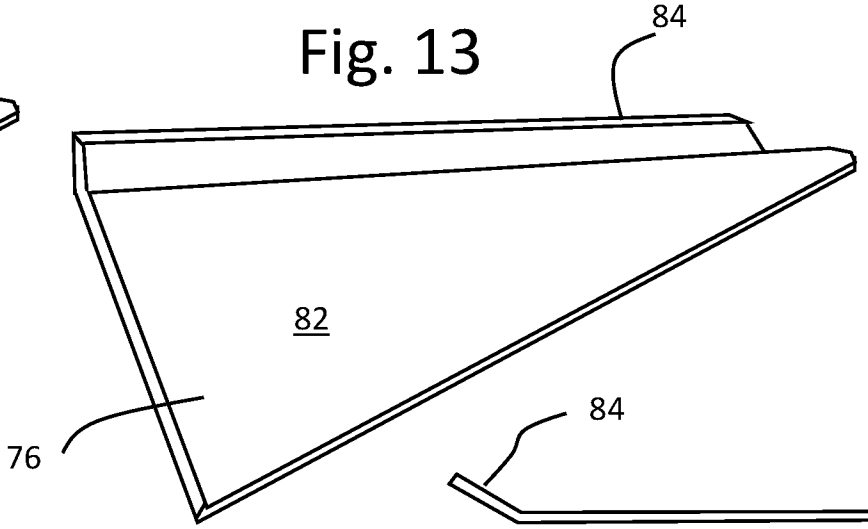
FIG. 13 is a perspective view of a chine wedge with an attachment tab for temporary attachment or permanent attachment of the chine wedge.
Figure 14:
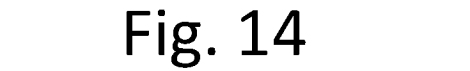
FIG. 14 is a side elevational view of the chine wedge of FIG. 13.
Figure 15:
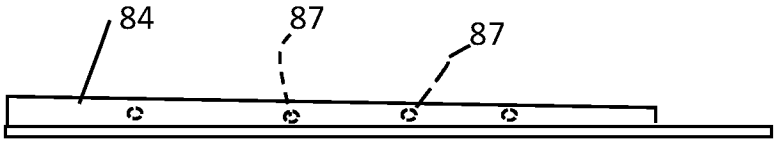
FIG. 15 is a front elevational view of the chine wedge of FIGS. 13 and 14.

Referring to FIG. 5, this temporary attachment allows the chine wedge 82 to be attached at a first chine wedge position 92. The pontoon boat with a motor arrangement can be then tested with data taken on desired performance parameters. The chine wedge can then be moved to a second chine wedge position 93 with further performance tests being ran, and the process repeated at other chine wedge locations 94. By readily attaching and detaching and testing performance characteristics, a desired mix of optimal characteristic may be identified and the chine wedge may then be retained at the respective location. In embodiments, the chine wedge may be welded to the pontoon. In embodiments, this procedure may be utilized in an after market context, for example if pontoon owner buys a new outboard engine for her pontoon, the owner may desire to tune the performance characteristics of the new pontoon/engine combination.

In embodiments, the performance characteristics may be altered utilizing the chine wedges in ways other than simply repositioning the chine wedges. Chine wedges of different sizes and shapes and set to different angular inclinations may be utilized for the experimental tuning processes. Each reverse chime may have more than one chine wedge and such chine wedges may be of different sizes and positioned with different inclinations.

Figure 16:
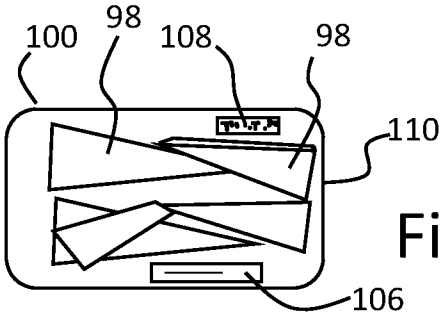
FIG. 16 is a view of a kit with chine wedges, fasteners, and instructions.

Referring to FIG. 16, chine wedges 98 may be provided as a kit 100 for aftermarket performance tuning of a pontoon boat, the kit 100 comprising a plurality of chine wedges 98, written instructions 106, such as on paper, for tuning selected performance characteristics, including attachment of the chine wedges to the pontoons of the pontoon boat, fasteners 108 for attachment of the chine wedges, and/or packaging 110 for enclosing the chine wedges, instructions, fasteners. The written instructions may conform to the methods described herein for performance tuning.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed. U.S. Pat. Nos. 11,312,450; 11,192,610; and 7,950,340 are incorporated by reference herein. The above references in all sections of this application are herein incorporated by references in their entirety for all purposes.

The following clauses illustrate example subject matter described herein.

Clause 1. A pontoon boat comprising: a deck; a starboard pontoon and a port pontoon mounted below the deck; a motor mounted on an aft end of the pontoon boat; wherein the starboard pontoon and the port pontoon each have a foil with a V-shape, each foil mounted to respective inner and lower quartile of the pontoon on an exterior surface of the pontoon and extending at least one third of the length of the respective pontoon, each foil in conjunction with the respective pontoon, defining a respective reverse chine extending the length of the respective foil;

the pontoon boat further comprising a starboard chine wedge fixed to the starboard pontoon at the reverse chine, and a port chine wedge fixed to the port pontoon at the respective reverse chine, each chine having a generally triangular or pie shaped plate portion with a forward upward inclination, a forward end of each chine wedge extending into an apex region of the respective reverse chine, the port chine wedge and the starboard chine wedge positioned at the same respective forward-rearward locations on each of the starboard and port pontoons.

Clause 2. The pontoon boat of clause 1, wherein each chine wedge has a length in the range of from about 10 inches to 22 inches.

Clause 3. The pontoon boat of clause 1 or 2, wherein each of the starboard and port chine wedges are welded to the respective foil and exterior surface of the respective pontoons.

Clause 4. The pontoon boat of any of clauses 1-3, wherein the port pontoon and the starboard pontoon each have an axis that together defines a horizontal plane, and wherein each of the chine wedges are mounted to the respective pontoon at an inclination angle in the range of 10° to 45° from the horizontal plane.

Clause 5. The pontoon boat of any of clauses 1-4, wherein each of the starboard chine wedge and port chine wedge has a rearward edge, and wherein a corner of the respective chine wedge is secured to the foil within 1 inch of an exterior apex of the foil.

Clause 6. The pontoon boat of any of clauses 1-5, wherein each of the starboard chine wedge and port chine wedge is attached to the respective foil at a location forward of midpoints of respective lengths of the foils.

Clause 7. The pontoon boat of any of clauses 1-6, wherein the pontoon boat further comprises a third central pontoon positioned between the port pontoon and the starboard pontoon, the third pontoon having a maximum width greater than a maximum width of the starboard pontoon and greater than a maximum width of the port pontoon.

Clause 8. The pontoon boat of any of clauses 1-7, wherein each V-shaped foil has a respective leg corresponding to the two legs of the V-shape, and wherein each leg has a length from 3 to 7 inches.

Clause 9. A pontoon boat comprising: a deck, the deck having a plurality of deck frame cross members; a plurality of pontoons connected to the plurality of deck frame cross members; a motor mounted on an aft end of the pontoon boat; wherein at least one of the plurality of pontoons each having a reverse chines with V-shaped recess, and said at least one of the plurality of pontoons has a respective chine wedge attached thereto and that is positioned in and extending across the V-shaped recess.

Clause 10. The pontoon boat of clause 9 wherein each of the respective chine wedges is configured as a plate with a generally triangular shape.

Clause 11. The pontoon boat of clause 9, wherein each of the chine wedges is formed from plate aluminum and has a thickness in the range of 0.13 to 0.25 inches.

Clause 12. The pontoon boat of any one of clauses 9-11, wherein the reverse chine is defined by a foil on the pontoon and the exterior surface of the pontoon.

Clause 13. The pontoon boat of clause 12, wherein the foil is welded to the exterior surface of the pontoon and formed from a generally triangular aluminum extrusion.

Clause 14. A method of tuning the performance parameters of a pontoon boat utilizing a plurality of chine wedges, the pontoon boat having a pair of pontoons with a reverse chine defined on each pontoon, the method comprising: providing a plurality of chine wedges, each chine wedge being a planar plate with opposing side edges converging toward a rearward end of the planar plate and with a rearward edge that defines the greatest width of the planar plate; temporarily fastening a pair of equally sized chine wedges of the plurality of chine wedges to a respective first chine wedge position at each of corresponding reverse chines on each of the two pontoons of the pontoon boat such that each chine wedge provides a lifting surface; measuring select performance parameters of the pontoon boat with the chine wedges at the first respective chine wedge positions; moving the pair of equally sized chine wedges to second respective chine wedge positions at each of the corresponding reverse chines on each of the two pontoons and temporarily fastening the pair of chine wedges thereto; measuring select performance parameters of the pontoon boat with the chine wedges at the second respective chine wedge positions; comparing the measured select performance parameters and selecting a chine position; and fixing the chine wedges to the selected chine positions.

Clause 15. The method of clause 14, wherein the measured select performance parameters include one or more performance parameters selected from the following set: top speed, handling characteristics, load capacity, tendency to porpoise, responsiveness in steering, and tendency for forward ends of the pontoons to dive.

Clause 16. A method of tuning the performance parameters of a pontoon boat utilizing a plurality of chine wedges, the pontoon boat having a plurality of reverse chines, the method comprising one or more of the following steps: measuring or observing performance parameters associated with the chine wedges and then repositioning the chine wedges and again measuring or observing the performance parameters associated with the repositioned chine wedges; measuring or observing performance parameters associated with the plurality of chine wedges and then swapping out the plurality of chine wedges with a new plurality of differently shaped or dimensioned chine wedges and again measuring or observing the performance parameters associated with the new plurality of differently shaped or dimensioned chine wedges; measuring or observing performance parameters associated with the plurality of chine wedges and then readjusting an angle of inclination of the plurality chine wedges and again measuring or observing the performance parameters associated with the readjusted angle of inclination of the plurality of chine wedges.

Clause 17. The method of clause 16, further comprising comparing the different performance parameters of the different test and selecting and utilizing a particular position, shape, dimension, and/or angle of inclination of the plurality of chine wedges and mounting selected chine wedges based on said comparing.

Clause 18. A method of tuning the performance parameters of a single hull boat or a pontoon boat utilizing a plurality of chine wedges, the single hull boat or pontoon boat having a plurality of reverse chines, the method comprising the following steps: measuring or observing performance parameters associated with the chine wedges positioned at specific positions on the plurality of reverse chines, and then repositioning the chine wedges on the plurality of reverse chines and again measuring or observing the performance parameters associated with the repositioned chine wedges.

Clause 19. The method of clause 18, further comprising swapping out the plurality of chine wedges with a new plurality of differently shaped or dimensioned chine wedges and again measuring or observing the performance parameters associated with the new plurality of differently shaped or dimensioned chine wedges.

Clause 20. The method of clause 18 or 19, further comprising the step of fixing at least a pair of the plurality of chine wedges at selected positions on the plurality of reverse chines based on the measuring or observing performance parameters.

Clause 21. A kit for performance tuning of a pontoon boat, the kit comprising a plurality of chine wedges for attachment to reverse chines on pontoons of a pontoon boat, the plurality of chine wedges having a generally triangular shape or pie shape, a forward end of each chine wedge positionable into an apex region of respective reverse chines, fasteners for attaching the plurality of chine wedges, and written instructions for the performance tuning.

While the aforementioned particular embodiments of the present invention have been shown and described, it will be obvious to those skilled in the art that, based upon the teachings herein, that changes and modifications may be made without departing from this invention and its broader aspects. Therefore, the appended claims are to encompass within their scope all such changes and modifications as are within the true spirit and scope of this invention. It will be understood by those with skill in the art that if a specific number of an introduced claim element is intended, such intent will be explicitly recited in the claim, and in the absence of such recitation no such limitation is present. For non-limiting example, as an aid to understanding, the following appended claims contain usage of the introductory phrases "at least one" and "one or more" to introduce claim elements. However, the use of such phrases should not be construed to imply that the introduction of a claim element by the indefinite articles "a" or "an" limits any particular claim containing such introduced claim element to inventions containing only one such element, even when the same claim includes the introductory phrases "one or more" or "at least one" and indefinite articles such as "a" or "an"; the same holds true for the use in the claims of definite articles.

The invention claimed is:

1. A method of tuning the performance parameters of a pontoon boat utilizing a plurality of chine wedges, the pontoon boat having a pair of pontoons with a reverse chine defined on each pontoon, the method comprising:

selecting a plurality of chine wedges, each chine wedge including a plate with opposing side edges converging toward a rearward end of the planar plate and with a rearward edge that defines the greatest width of the plate;

temporarily fastening a pair chine wedges of the plurality of chine wedges to a respective first chine wedge position at each of corresponding reverse chines on each of the two pontoons of the pontoon boat such that each chine wedge provides a lifting surface, measuring select performance parameters of the pontoon boat with the chine wedges at the first respective chine wedge positions;

moving the pair of equally sized chine wedges to second respective chine wedge positions at each of the corresponding reverse chines on each of the two pontoons and temporarily fastening the pair of chine wedges thereto;

measuring select performance parameters of the pontoon boat with the chine wedges at the second respective chine wedge positions;

comparing the measured select performance parameters and selecting respective chine position based on said comparing; and fixing the chine wedges to the selected respective chine positions.

2. The method of claim 1, wherein the measured select performance parameters include one or more performance parameters selected from the following set: top speed, handling characteristics, load capacity, tendency to porpoise, responsiveness in steering, and tendency for forward ends of the pontoons to dive.

3. The method of claim 1, including: fixing at least a pair of the plurality of chine wedges at selected positions on the plurality of reverse chines based on the measuring or observing performance parameters.

4. The method of claim 1, including fixing the at least a pair of the plurality of chime wedges by welding.

5. The method of claim 1, including fixing the at least a pair of the plurality of chine wedges by utilizing threaded fasteners.

6. The method of claim 1, wherein the step of selecting a plurality of chine wedges includes selecting the plurality from a plurality of differently sized chine wedges.

7. The method of claim 1, wherein the step of selecting a plurality of chine wedges includes selecting the plurality from a kit that includes fasteners and written instructions.

* * * * *